US005341902A

United States Patent [19]

Ruiz, Sr. et al.

[11] Patent Number: 5,341,902

[45] Date of Patent: Aug. 30, 1994

[54] ENERGY SAVER ELEVATOR

[76] Inventors: Rene A. Ruiz, Sr., 8419 Bellaire Blvd., Houston, Tex. 77036; George Spector, 233 Broadway Rm 702, New York, N.Y. 10279

[21] Appl. No.: 27,458

[22] Filed: Mar. 8, 1993

[51] Int. Cl.[5] ..... B66B 11/04

[52] U.S. Cl. ..... 187/19; 187/114; 318/139

[58] Field of Search ..... 187/19, 20, 6, 78, 112, 187/114, 105; 182/141, 36; 318/139

[56] References Cited

U.S. PATENT DOCUMENTS 920,630 5/1909 Ocumpaugh ..... 187/19
3,415,343 12/1968 Svensson ..... 187/19
3,878,916 4/1975 White, Jr. ..... 187/19
4,456,097 6/1984 Salihi ..... 187/112
4,548,299 10/1985 Nomura ..... 187/105
4,592,450 6/1986 Schaffer ..... 187/19
4,865,155 9/1989 Montaigne et al. ..... 187/19

*Primary Examiner*—Kenneth W. Noland

[57] ABSTRACT

An energy saver elevator is provided which consists of an elevator car, an elongated cable connected to the elevator car and a counterweight connected to the elongated cable. A DC power source and an auxiliary AC power source are also provided. A mechanism powered by the DC power source during normal conditions and by the auxiliary AC power source during emergency conditions, is for propelling the elevator car. A device is for recharging the normal DC power source by the motion of the elevator car and an apparatus is for stopping the elevator car.

2 Claims, 2 Drawing Sheets

AUX. DC POWER SOURCE
BATT. CHARGER AC/ADAPTER
DC POWER SOURCE

ENERGY SAVER ELEVATOR

BACKGROUND OF THE INVENTION

The instant invention relates generally to elevator control systems and more specifically it relates to an energy saver elevator, which provides a mechanism operated by DC current stored in batteries that can be used during normal operation.

There are available various conventional elevator control systems which do not provide the novel improvements of the invention herein disclosed.

SUMMARY OF THE INVENTION

A primary object of the present invention is to provide an energy saver elevator that will overcome the shortcomings of the prior art devices.

Another object is to provide an energy saver elevator that contains an auxiliary DC power source which when activated will operate the elevator during emergency conditions when the regular DC power source is inoperable, such as in a fire and the like.

An additional object is to provide an energy saver elevator that contains a mechanism for recharging the normal DC power source by the motion of the elevator car.

A further object is to provide an energy saver elevator that is simple and easy to use.

A still further object is to provide an energy saver elevator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4, 5, 6, 9:
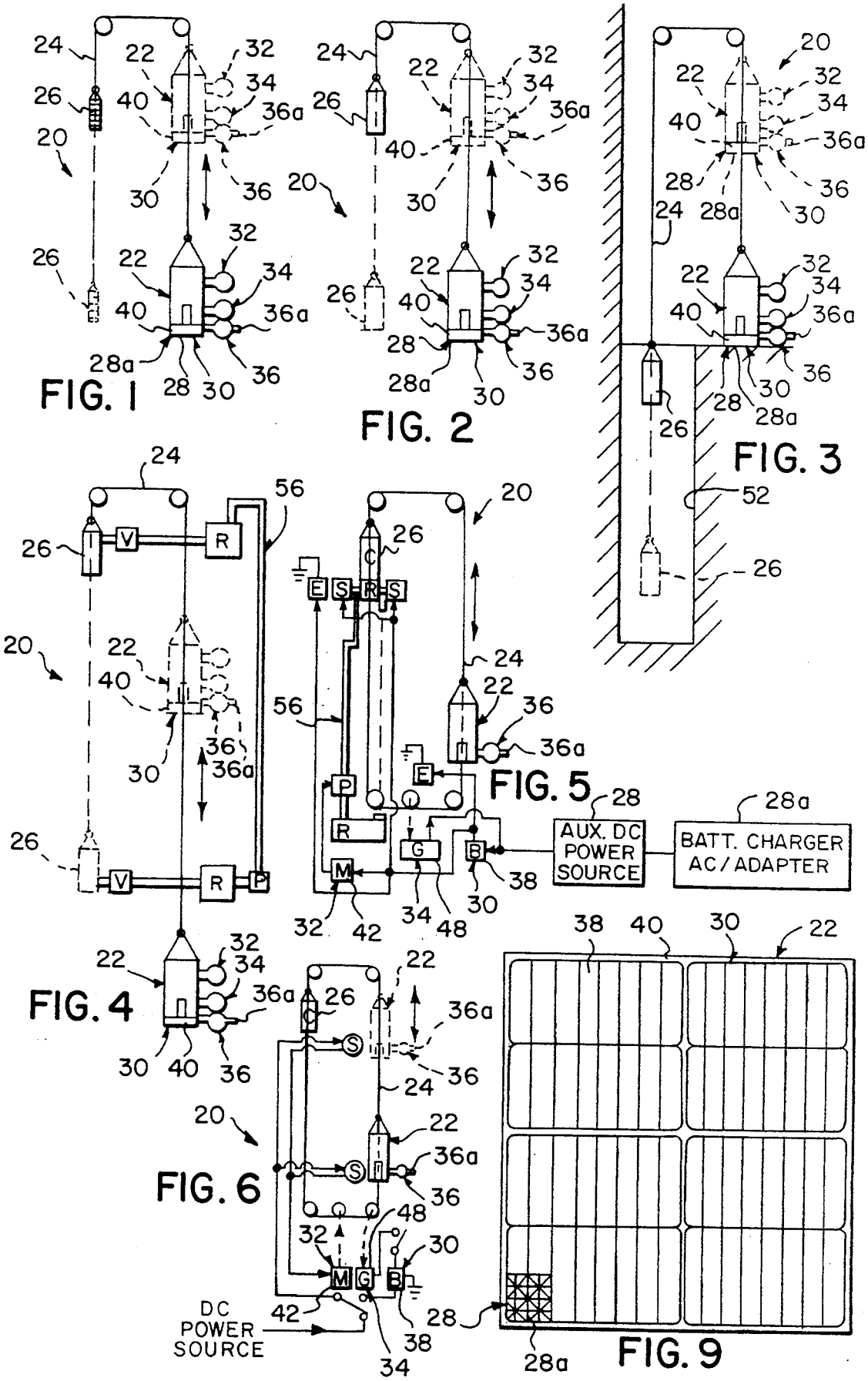
FIG. 1 is a diagrammatic elevational view of the instant invention in which the counterweight is of a solid construction.
FIG. 2 is a diagrammatic elevational view similar to FIG. 1, in which the counterweight can incorporate a liquid tank.
FIG. 3 is a diagrammatic elevational view similar to FIG. 1, in which the counterweight can travel within a chamber below ground level.
FIG. 4 is a diagrammatic elevational view in which the counterweight is a liquid tank that is filled and emptied by a hydraulic unit for operation thereof.
FIG. 5 is a diagrammatic elevational view in which the elevator car and the liquid tank counterweight are connected to a continuous cable which operates a remote generator system to provide electric power to a remote electric motor system to operate the hydraulic unit.
FIG. 6 is a diagrammatic elevational view in which the elevator car and the solid counterweight are connected to a continuous cable operated by a remote electric motor system, so that the movement of the cable operates a remote generator system to recharge remote batteries.
FIG. 9 is a diagrammatic cross sectional view taken through the battery compartment of the elevator car as indicated along line 9—9 in FIG. 7.

Turning now descriptively to the drawings, in which similar reference characters denote similar elements throughout the several views, the Figures illustrate an energy saver elevator 20 which consists of an elevator car 22, an elongated cable 24 connected to the elevator car 22 and a counterweight 26 connected to the elongated cable 24. A DC power source 30 and an auxiliary DC power source 28 are also provided. A mechanism 32, powered by the DC power source 30 during normal conditions and by the auxiliary DC power source 28 during emergency conditions, is for propelling the elevator car 22. An AC/DC adapter **28*a* is used to recharge the auxiliary DC power source 28 by the conversion of AC to DC power, to become the AC/DC power charger and an apparatus 36 is for stopping the elevator car 22**.

The normal DC power source 30 is a plurality of batteries 38, which in a first instance can be located in the bottom 40 of the elevator car 22, in a second instance can be located at a remote location and can be charged by AC/DC auxiliary power source 28 and recharger **28*a***.

The propelling mechanism 32 is an electric motor system 42, which in a first instance can be located between a center spar 44 on the elevator car 22 and a vertical box channel 46 and in a second instance can be located at a remote location to raise and lower the counterweight 26.

The recharging device 34 is a generator system 48, which in a first instance can be located between the center spar 44 on the elevator car 22 and the vertical box channel 46 and in a second instance can be located at a remote location. The stopping apparatus 36 is dynamic brake system 50 in combination with stop pin 36A will work on every floor and during emergency full stops between the center spar 44 on the elevator car 22 and the vertical box channel 46 the stopping apparatus is constructed from conventional and well known braking apparatus.

The counterweight 26 can be of a solid construction as shown in FIG. 1, can incorporate a liquid tank as shown in FIGS. 2 and 4 and can travel within a chamber 52 below ground level 54 as shown in FIG. 3. The counterweight 26 in FIG. 4 is filled and emptied by a hydraulic unit 56 for operation thereof.

In FIG. 5 the elevator car 22 and the liquid tank counterweight 26 are connected to a continuous cable 24, which operates the remote generator system 48 that provides electric power to the remote electric motor system 42 which operates the hydraulic unit 56.

In FIG. 6 the elevator car 22 and the solid counterweight 26 are connected to a continuous cable 24, which is operated by a remote electric motor system 42, so that the movement of the cable 24 operates a remote generator system 48 to recharge the remote batteries 38, as when a conventional switch between the generator and batteries is closed.

Figure 7:
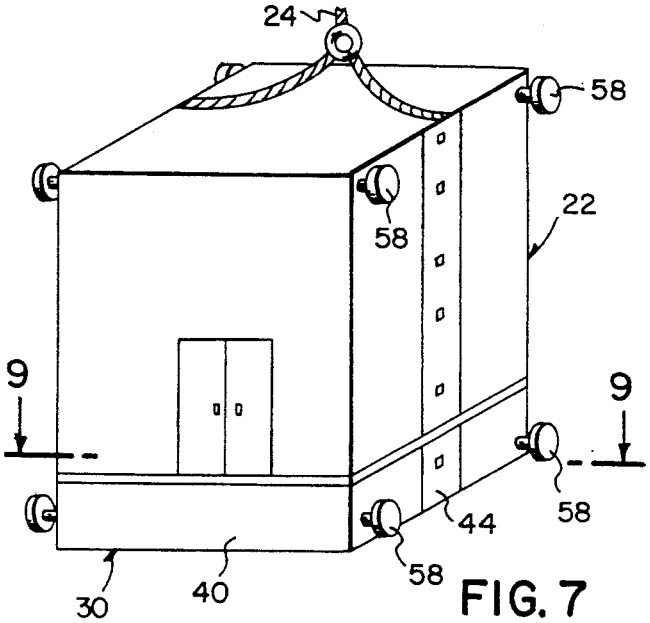
FIG. 7 is a diagrammatic perspective view of the new elevator car which can operate in combination with each of the counterweights shown in FIGS. 1 through 4.
Figure 10:
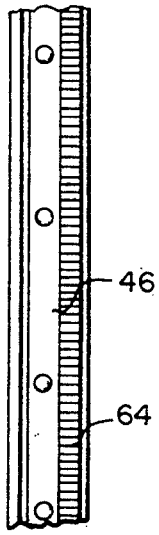
FIG. 10 is a diagrammatic perspective view of a box channel.
Figure 12:
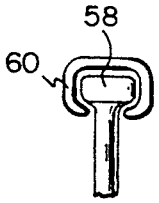
FIG. 12 is a diagrammatic top view of a guide channel and one of the guide rollers of the elevator car shown in FIG. 7.
Figure 11:
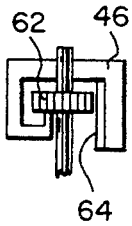
FIG. 11 is a diagrammatic top view of the box channel and one of the gears.

Guide rollers 58 on the elevator car 22 ride in guide channels 60, as best seen in FIGS. 7 and 12. Gears 62 on the electric motor system 42, the generator system 48 and the dynamic brake system 50 ride on teeth 64 in the box channel 46.

Figure 13:
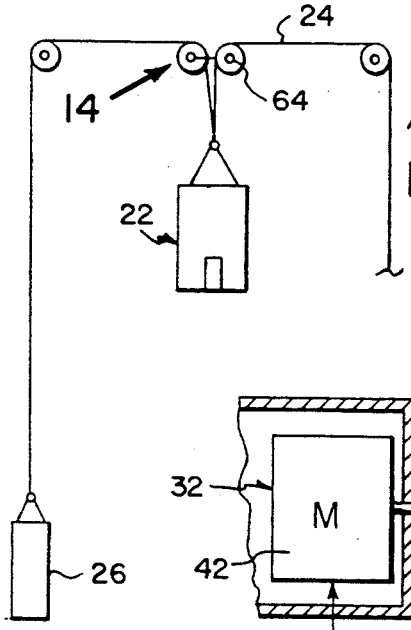
FIG. 13 is a diagrammatic elevational view in which a twin pulley shaft is utilized in conjunction with the cable in raising and lowering the elevator car and counterweight.
Figure 15:
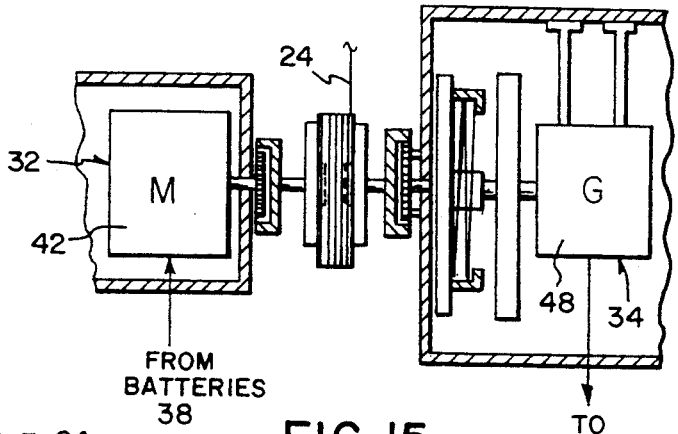
FIG. 15 is a diagrammatic cross sectional view of the remote electric motor and generator systems which are coupled to the cable shown in FIG. 13.
Figure 14:
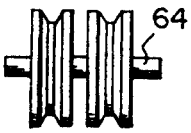
FIG. 14 is a diagrammatic side view of the twin pulley shaft as indicated by arrow 14 in FIG. 13.
Figure 8:
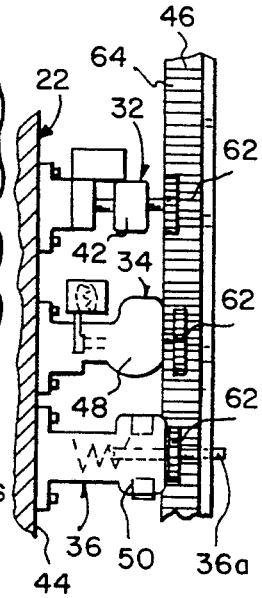
FIG. 8 is a diagrammatic side view of the electric motor, generator and dynamic brake systems which are mounted to the center spar of the elevator car in FIG. 7, showing the respective gears coacting with a box channel.

In FIGS. 13 and 14, a twin pulley shaft 64 is utilized in conjunction with the cable 24 in raising and lowering the elevator car 22 and the counterweight 26. FIG. 15 shows the cable 24 coupled to the remote electric motor and generating systems 42 and 48.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An energy saver elevator which comprises:

a) an elevator car;

b) an elongated cable connected to said elevator car;

c) a counterweight connected to said elongated cable;

d) DC power battery source for normal conditions;

e) an auxiliary DC power source;

f) means powered by said DC power source during normal conditions and by said auxiliary DC power source during emergency conditions, when said battery power source is discharged;

g) means for recharging said normal DC power source by the motion of said elevator car; and h) means for stopping said elevator car; wherein said normal DC power source includes a plurality of batteries, which can be located in the bottom of said elevator car and; wherein a propelling means is an electric motor system, which is located between a center spar on said elevator car and a vertical center box channel, to raise and power said counterweight; wherein said recharging means is a generator system with an extending pinion located between said center spar on said elevator car and a stationary rack in the form of said vertical center box channel; whereby said pinion is driven by said rack when said car is in motion.

2. An energy saver elevator as recited in claim 1, wherein said stopping means is a dynamic brake system located between said center spar on said elevator car and said stationary rack.

* * * * *